United States Patent [19]

Taifu et al.

[11] 4,456,568

[45] Jun. 26, 1984

[54] CARBURETOR CHOKE VALVE OPENING DEVICE

[75] Inventors: Tatsuya Taifu; Hidemi Oonaka, both of Susono, Japan

[73] Assignee: Toyota Jidosha Kabushiki Kaisha, Aichi, Japan

[21] Appl. No.: 451,424

[22] Filed: Dec. 20, 1982

[51] Int. Cl.[3] ..... F02M 1/14

[52] U.S. Cl. ..... 261/39 A; 261/64 C; 261/64 E

[58] Field of Search ..... 261/64 C, 64 E, 39 A

[56] References Cited

U.S. PATENT DOCUMENTS

| | | | |
|---|---|---|---|
| 3,011,770 | 12/1961 | Stoltman | 261/39 A |
| 3,578,293 | 5/1971 | Santi | 261/64 C |
| 3,872,188 | 3/1975 | Brown et al. | 261/39 A |
| 3,987,131 | 10/1976 | Hisatomi et al. | 261/39 A |
| 4,119,683 | 10/1978 | Tamura | 261/64 C |
| 4,317,374 | 3/1982 | Casey | 261/39 A |

FOREIGN PATENT DOCUMENTS

| | | | |
|---|---|---|---|
| 52-8234 | 1/1977 | Japan | 261/39 A |
| 52-76531 | 6/1977 | Japan | 261/39 A |
| 55-32971 | 7/1980 | Japan | 261/64 E |

*Primary Examiner*—Tim R. Miles

*Attorney, Agent, or Firm*—Parkhurst & Oliff

[57] ABSTRACT

A carburetor choke opening device wherein an altitude compensator opens an additional passage containing a delay element to vacuum at high altitudes so as to increase the amount of vacuum applied to the choke valve opening device at high altitudes, to insure that the choke valve continues to be opened without undue delay at high altitudes.

6 Claims, 2 Drawing Figures

FIG.1
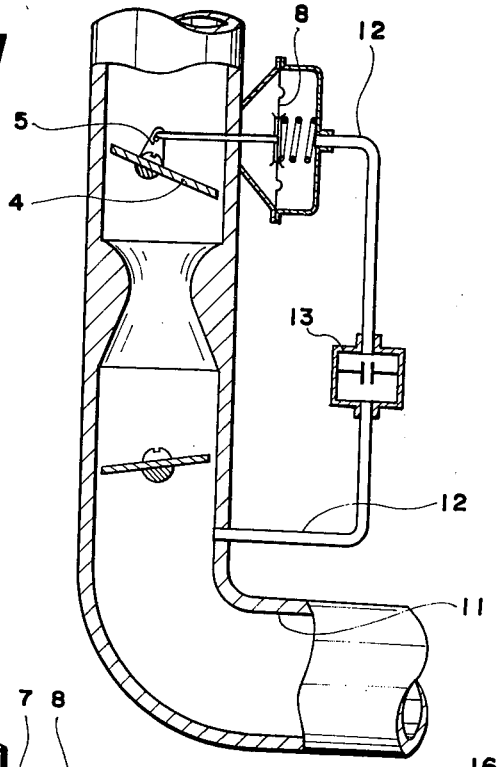
PRIOR ART
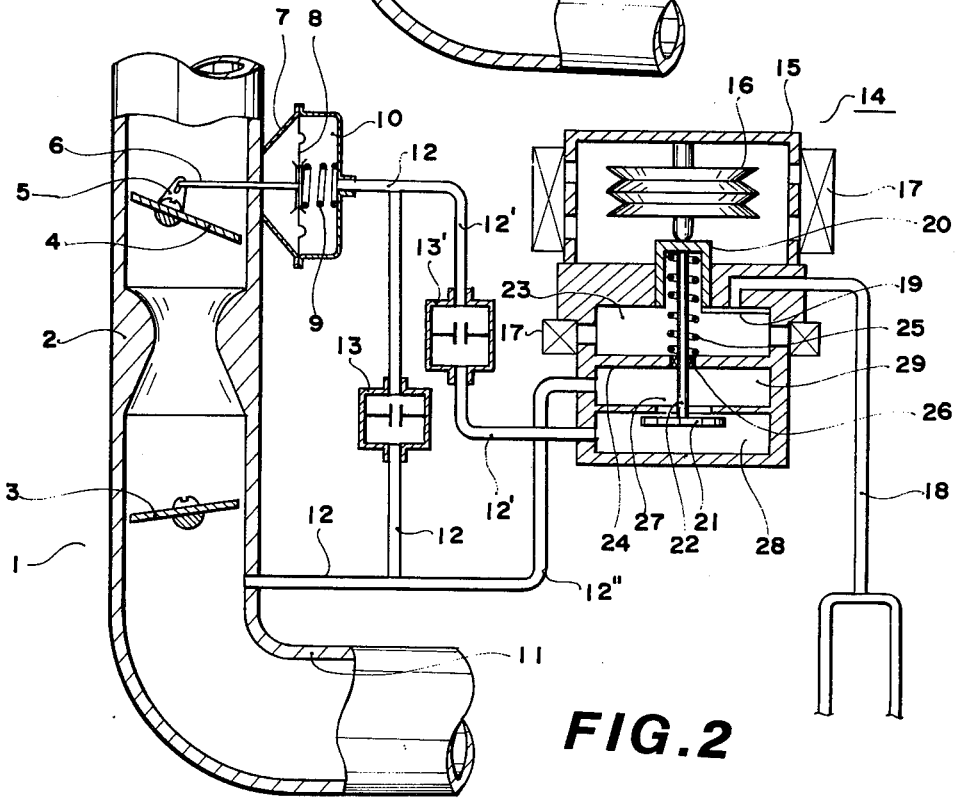
FIG.2

CARBURETOR CHOKE VALVE OPENING DEVICE

BACKGROUND OF THE INVENTION (1) Field of the Invention

The present invention relates to a vacuum-type choke valve opening device wherein a choke valve provided on the upstream side of a Venturi part of a carburetor is connected to a diaphragm through links, while a vacuum chamber of the diaphragm is connected to an intake manifold through a passage having a vacuum delay element such as a throttle. More particularly, the invention pertains to a carburetor choke valve opening device having an altitude compensating function, wherein another passage having another delay element is connected to the vacuum chamber of the diaphragm and further connected to a control chamber separated from a vacuum chamber by a changeover valve adapted to interlock with a bellows of a conventional bellows type altitude compensator, while the vacuum chamber is connected to the intake manifold.

(2) Description of the Prior Art

As is generally known, such various valve opening devices have been developed and employed for smoothing the starting of automobile engines under a cold state as having a choke valve provided on the upstream side of a Venturi part in order to shift a rich air-fuel ratio at starting to a normal air-fuel ratio after starting.

Such a device has been employed for reliably opening the choke valve after starting, with the starting taken as a trigger, that, as shown in FIG. 1, the vaccum in an intake manifold 11 is introduced through a passage and applied to a diaphragm 8 through a vacuum delay valve such as a throttle valve 13 so as to be an actuator for actuating a link 53 to open a choke valve 4.

The choke valve opening device of the type mentioned above, however, has the following problems, since it is designed on a basic condition of the normal cold engine starting at a level land, i.e., the cold engine starting under an atmospheric pressure at a level land.

Since the intake manifold is communicated with the atmospheric air when the engine is in an operative state, the intake manifold is naturally affected by the atmospheric pressure. Therefore, the intake manifold vacuum under a low atmospheric pressure at a highland is lower than that under an atmospheric pressure at a level land.

Accordingly, at the cold engine starting at a highland, there is a corresponding delay in the operation of the vacuum sucking force in the vacuum chamber of the diaphragm through the delay element. In consequence, the choke valve is opened later at a highland than at a level land, so that the period during which the air-fuel ratio is over rich is longer correspondingly. Thus, there is such a shortcoming that the engine is unstable in idling. Moreover, there is such a problem that the exhaust emission control cannot be smoothly effected.

SUMMARY OF THE INVENTION

It is, therefore, an object of the present invention to provide an excellent carburetor choke valve opening device arranged such that the flow rate of the vacuum applied to the delay element is changed through an altitude compensator in response to the change in the intake manifold vacuum characteristics according to the altitude in order to make the responsive vacuum timing at a level land compatible with that at a highland for improving the drivability and the exhaust emission countermeasure, thereby solving the above-mentioned problems of the vacuum-type choke valve opening device in accordance with the prior art.

BRIEF DESCRIPTION OF THE DRAWINGS

FIG. 1 is a sectional view of a vacuum-type choke valve opening device in accordance with the prior art; and FIG. 2 is a sectional view of a carburetor choke valve opening device in accordance with one preferred embodiment of the invention.

DESCRIPTION OF THE PREFERRED EMBODIMENTS

In FIG. 2, a carburetor 1 has a throttle valve 3 provided on the downstream side of a Venturi part 2 and a choke valve 4 provided on the upstream side thereof. The choke valve 4 is connected through links 5, 6 to a diaphragm 8 of a diaphragm device 7 provided to a barrel.

A passage 12 is provided connecting a vacuum chamber 10 having a return spring 9 attached to the diaphragm 8 and an intake manifold 11 and is provided with a throttle 13 as a delay element.

It is to be noted that the throttle 13 is set so as to have a throttling value for the level land atmospheric pressure operation, i.e., the lowland atmospheric pressure operation, similar to the conventional form.

On the other hand, an altitude compensator 14, which constitutes the subject matter of the invention, has a casing 15. Inside the upper part of the casing 15, a bellows 16 enclosing a level land set atmospheric pressure is provided so as to be expanded and contracted by the atmospheric pressure communicating with the bellows 16 through an air filter 17. A pusher 20, which is adapted to actuate a valve plate 19 for opening and closing an air bleed passage 18 communicating with a known main air bleed port and a known slow air bleed port, not shown, is loosely received by a casing 15 so as to be able to contact with the bellows 16, the pusher 20 being provided with a rod 22 having a changeover valve 21 and extending downwardly. The pusher 20 is upwardly energized by means of a pressure spring 25 loaded between the pusher 20 and a partition wall 24 of an air bleed chamber 23 communicating with the outside air through an air filter 17.

In addition, a seal 26 is provided to the rod 22 penetrating through the partition wall 24.

Moreover, the casing 15 is provided with a communication opening 27 and partitioned by the changeover valve 21 into a control chamber 28 and a vacuum chamber 29. The control chamber 28 is communicated with the vacuum chamber 10 of the diaphragm 8 through another passage 12' having a low-atmospheric pressure throttle 13' as another delay element.

In the arrangement described above, in case of starting the engine in a cold state at a level land, since the atmospheric pressure is higher that that at a highland, the bellows 16 of the altitude compensator 14 is in a contracted state. Therefore, the valve plate 19 blocks the air bleed passage 18, and the changeover valve 21 shuts off the vacuum chamber 29 and the control chamber 28 from each other. When the engine is started under such conditions, the level land vacuum produced in the intake manifold 11 is introduced into only the passage 12, and owing to the delay action through the throttle 13, a vacuum against the pressure spring 9 is formed in the vacuum chamber 10 of the diaphragm 8 according to the set timing. In consequence, the choke valve 4 is opened with a delay through the links 5, 6, so that the air-fuel ratio is prevented from being over rich. Accordingly, the engine is warmed up without any idling failure and deterioration of the exhaust emission control.

On the other hand, in the case where the engine of the automobile having moved to a highland is started in a cold state under a low atmospheric pressure, the bellows 16 is in an expanded state contrary to the above, lowering the pusher 20 against the pressure spring 25. In consequence, the valve plate 19 allows the bleed passage 18 to be open, and the changeover valve 21 permits the control chamber 28 and the vacuum chamber 29 to communicate with each other through the communication opening 27. Therefore, the throttle 13' is also connected with the passage 12 connecting to another passage, and the vacuum chamber 29 is connected with the part of the passage 12 on the side of the intake manifold 11 through the passage 12''.

In the arrangement described above, in case of starting the engine in a cold state at a level land, since the atmospheric pressure is higher that that at a highland, the bellows 16 of the altitude compensator 14 is in a contracted state. Therefore, the valve plate 19 blocks the air bleed passage 18, and the changeover valve 21 shuts off the vacuum chamber 29 and the control chamber 28 from each other. When the engine is started under such conditions, the level land vacuum produced in the intake manifold 11 is introduced into only the passage 12, and owing to the delay action through the throttle 13, a vacuum against the pressure spring 9 is formed in the vacuum chamber 10 of the diaphragm 8 according to the set timing. In consequence, the choke valve 4 is opened with a delay through the links 5, 6, so that the air-fuel ratio is prevented from being over rich. Accordingly, the engine is warmed up without any idling failure and deterioration of the exhaust emission control.

On the other hand, in the case where the engine of the automobile having moved to a highland is started in a cold state under a low atmospheric pressure, the bellows 16 is in an expanded state contrary to the above, lowering the pusher 20 against the pressure spring 25. In consequence, the valve plate 19 allows the bleed passage 18 to be open, and the changeover valve 21 permits the control chamber 28 and the vacuum chamber 29 to communicate with each other through the communication opening 27. Therefore, the throttle 13' and the passage 12' are also communicated with the intake manifold 11.

When the engine is started under such conditions, although a vacuum lower than that at a level land is produced in the intake manifold 11 as described above, since the two throttles 13, 13' are communicated with the vacuum chamber 10 of the diaphragm 8 through the passages 12, 12'', 12', the amount of applied vacuum increases by the portion passing through the throttle 13'. Therefore, the vacuum is formed earlier than the case where only the throttle 13 for a level land is employed. As a result, even under a low atmospheric pressure at a highland the diaphragm 8 operates at substantially the same delayed timing as under the atmospheric pressure at a level land. In consequence, the choke valve 4 is opened through the links 5, 6, and the air bleeding is effected also through the main system and the slow system.

Accordingly, even under a low atmospheric pressure at a highland, the valve opening timing of the choke valve 4 has the same characteristics as under the atmospheric pressure at a level land. Thereby, the air-fuel ratio is prevented from being over rich, and the engine is prevented from being unstable in idling, and moreover, the deterioration of the exhaust emission control is prevented.

It is a matter of course that the form embodying the invention is not limited to the embodiment described above and a variety of forms may be employed. For instance, a needle valve may be employed as the changeover valve. Moreover, the vacuum delay valve for a low-atmospheric pressure may be of a kind of two-stage type.

As will be fully understood from the foregoing description, the invention provides excellent effects as follows. According to the invention, in the valve opening device wherein the diaphragm is operated through the delay element communicating with the intake manifold vacuum with respect to the choke valve of the carburetor, another passage provided with another throttle is connected between the vacuum chamber of the diaphragm and the intake manifold, and moreover, the passage is communicated with the control chamber and the vacuum chamber of the altitude compensator, and the communication opening between both the chambers can be opened and closed by means of the changeover valve adapted to interlock with the bellows. Therefore, the passage is communicated with the intake manifold only under a low atmospheric pressure at a highland. Accordingly, even if an intake manifold vacuum lower than the vacuum under the atmospheric pressure at a level land is formed in the intake manifold at the cold engine starting at the highland, since the vacuum passes through the two throttles, the diaphragm operates at a timing substantially the same as that under the atmospheric pressure at a level land. Accordingly, the diaphragm characteristics can be maintained substantially constant independently of the altitude.

Since the choke valve is opened with the same delay characteristics at all times, the air-fuel ratio is prevented from being over rich even at a highland. Therefore, there is no instability in idling, and moreover, it is possible to prevent deterioration of the exhaust emission control.

Furthermore, there is provided such an effect that the throttle for a highland can be automatically actuated by the altitude compensator.

What is claimed is:

1. A carburetor choke valve opening device wherein said choke valve is linked with a diaphragm connected with an intake manifold of said carburetor through a passage with a delay element, characterized in that a changeover valve connected with a bellows of a bellows-type altitude compensator is adapted to separate a vacuum chamber and a control chamber from each other so that they can be opened and closed, said vacuum chamber being connected to said intake manifold through a passage, while said control chamber being connected to said diaphragm through another passage with another delay element.

2. A carburetor choke valve opening device as defined in claim 1, wherein said changeover is a plate type valve.

3. A carburetor choke valve opening device as defined in claim 1, wherein said changeover valve is a needle type valve.

4. A carburetor choke valve opening device as defined in claim 1, wherein each of said delay element and said another delay element is a throttle valve.

5. A carburetor choke valve opening device as defined in claim 2, wherein each of said delay element and said another delay element is a throttle valve.

6. A carburetor choke valve opening device as defined in claim 3, wherein each of said delay element and said another delay element is a throttle valve.

* * * * *